US006250024B1

(12) United States Patent
Sculthorpe et al.

(10) Patent No.: US 6,250,024 B1
(45) Date of Patent: Jun. 26, 2001

(54) TEMPORARY BRACING SYSTEM FOR INSULATED CONCRETE FORM WALLS AND METHOD

(76) Inventors: Robert Elias Sculthorpe, 27 Ravine Drive, Northumberland Ontario (CA), L1A 4G8; Bruce R. Cooper, 11 Centennial Drive, Port Hope Northumberland Ontario (CA), L1A 3S9; John Maguire, R.R.#1 1224 Cenerton Rd, Grafton Ontario (CA), K0K 2G0

( * ) Notice: Subject to any disclaimer, the term of this patent is extended or adjusted under 35 U.S.C. 154(b) by 0 days.

(21) Appl. No.: 09/213,176

(22) Filed: Dec. 17, 1998

(51) Int. Cl.[7] ..... E04G 25/02

(52) U.S. Cl. ..... 52/127.2; 52/426; 52/432; 52/699; 52/745.12; 249/211; 249/219.2; 264/35

(58) Field of Search ..... 52/127.1, 127.2, 52/351, 353, 422, 425, 426, 431, 432, 435, 699, 745.12; 249/189, 190, 211, 219.1, 219.2; 264/35

(56) References Cited

U.S. PATENT DOCUMENTS

| | | | | |
|---|---|---|---|---|
| 1,619,947 | * | 3/1927 | Makowski | 52/353 |
| 1,721,685 | * | 7/1929 | Bosco | 249/211 X |
| 3,174,203 | | 3/1965 | Kemper . | |
| 3,591,123 | | 7/1971 | Edwards . | |
| 3,817,006 | | 6/1974 | Williams . | |
| 4,147,483 | | 4/1979 | Rovera et al. . | |
| 4,290,576 | | 9/1981 | Schwörer . | |
| 4,333,289 | | 6/1982 | Strickland . | |
| 4,397,441 | | 8/1983 | Manderla . | |
| 4,791,767 | * | 12/1988 | Boeshart | 52/426 |
| 4,880,204 | * | 11/1989 | Steele | 249/219.2 |
| 5,212,920 | | 5/1993 | Tye . | |
| 5,248,122 | | 9/1993 | Graham . | |
| 5,390,459 | | 2/1995 | Mensen . | |
| 5,572,838 | | 11/1996 | Truitt et al. . | |
| 5,657,600 | | 8/1997 | Mensen . | |
| 5,809,727 | | 9/1998 | Mensen . | |

* cited by examiner

*Primary Examiner*—Carl D. Friedman
*Assistant Examiner*—Kevin D. Wilkens
(74) *Attorney, Agent, or Firm*—Morgan, Lewis & Bockius LLP

(57) ABSTRACT

A system and method for securing an insulated concrete wall form to an existing support/bracing structure such as a strongback for keeping the form straight and plumb during construction. The attachment system uses a flexible member, such as a tensioning plastic strap, to hold the strongback against insulated panels of the insulated concrete wall form. Openings are cut through the insulated panels to provide a pathway for the strap. A horizontal anchoring bar is positioned in the insulated concrete wall form to secure the strap. The strap is threaded through one of the openings, wrapped around the anchoring bar and then threaded out through the other opening. The strap is wrapped around a strongback and the ends of the strap are secured using a crimp connector. A wedge may also be inserted between the strongback and the strap and pressed downwardly to adjust the tension of the strap and align the insulated concrete wall form against the strongback.

16 Claims, 3 Drawing Sheets

TEMPORARY BRACING SYSTEM FOR INSULATED CONCRETE FORM WALLS AND METHOD

BACKGROUND OF THE INVENTION

1. Field of the Invention

The invention relates generally to insulated concrete form ("ICF") wall bracing, and more particularly, to a system and method for bracing an insulated concrete wall form to a support/bracing structure to align and support the ICF wall during construction.

2. Description of the Related Art

Conventional building construction utilizes concrete walls that are normally produced by constructing form walls, pouring concrete into the space between the walls and, upon setting of the concrete, removing the form walls. A conventional concrete form wall is disclosed in U.S. Pat. No. 4,333,289 to Strickland. The form wall includes a pair of spaced opposed panels made from plywood and defining therebetween a space into which soft concrete is poured in forming the wall. Horizontally spaced vertical stiffeners or strongbacks are provided outwardly of each plywood panel to provide major strengthening for the panel support structure. Elongate beams or walers are also provided to extend horizontally along the outer side of each panel. An outwardly opening pocket formed as part of the waler retains a wooden nailer to which the plywood form panel can be nailed, screwed or otherwise fastened to the waler.

Another system for temporarily attaching a reinforcing beam to a poured concrete structural member is shown in U.S. Pat. No. 5,572,838 to Truitt et al. An insert is adapted to be set in the poured concrete member. The insert has a body that creates a void in the concrete structural member and leg members that are partially set in the poured concrete with portions thereof extending through the body of the insert so as to be free of concrete. A special bolt engages with the leg members and provides a means for securing a reinforcement beam to the concrete structural member.

More recent building systems involve the use of insulated concrete forms (ICFs), which use a foam insulating material to construct permanent concrete form walls. The form walls are typically constructed by placing separate building components (also known as form blocks) upon each other. The concrete is then poured and the form walls are left in place after the concrete hardens to become a permanent part of the wall. Advantages provided by the use of ICFs include a reduction in the number of operations normally associated with building construction and generally the elimination of a need to provide further insulation. An example of particularly advantageous types of ICFs appears in U.S. Pat. Nos. 5,390,459; 5,657,600; and 5,809,727 to Mensen (Mensen), the disclosures of which are incorporated by reference herein in their entirety. In general, the ICFs taught by Mensen are made from a building component or block that includes first and second foam side panels. The side panels are preferably made of expanded polystyrene and are arranged in spaced parallel relationship with their inner surfaces facing each other. Plastic bridging members hold the side panels together against the forces applied by the poured concrete. Each bridging member includes end plates, which line up when the components are stacked to form furring strips for attachment of finishing materials.

With the advent of the use of stay-in-place forms or permanent concrete form work, such as ICFs, there is a need in the building construction art for an efficient, cost-effective and reliable apparatus and method to support the building components that make up the ICFs against construction loads. The insulated side panels of an ICF do not provide a strong surface to which reinforcing beams can be easily attached, as with plywood side panels. Commercial, institutional and industrial buildings often require walls higher than 8 to 9 feet in order to incorporate machinery, warehousing and high wall assemblies. Wall forms used in pouring in place such high vertical walls must be supported against various construction loads including wind loads, alignment loads, scaffold loads, and loads created by the hydrostatic pressure of the liquid concrete poured into the wall forms. Falsework is the construction industry term for structural supports and the necessary bracing required for the support of temporary loads during construction. Existing means for attaching strongbacks or reinforcing beams to wall forms do not lend themselves to the attachment of insulated panels on ICFs to conventional falsework.

Existing bracing systems used in ICF wall construction also do not adequately address the problems of supporting and controlling ICFs during construction, particularly in high wall applications of ICF (such as when the ICF is used to construct a wall of greater than 12 feet in height). For example, although conventional stage scaffolding has been used with ICFs, it is not recommended because it is a structure that generally must be braced itself, and is not designed for wind and other horizontal loads.

Accordingly, a bracing system such as shown in FIG. 3 has been used in ICF wall construction. This known system includes a vertical box channel 120 that is connected to the ICF blocks before they are filled with concrete using screws 122 that pass through the box channel 120 and into exposed end plates 124 of the plastic bridging members in the ICF blocks. As discussed above, the end plates 124 of each bridging member in the ICF blocks line up when the ICF blocks are stacked. The resulting "furring strip" provides the support for the vertical box channel 120. With walls reaching 12' to 14' high a 2"×6" wooden board (not shown) can be screwed into the furring strip with screws that pass through vertical slots in the board. The board forms a "strong-back" that can extend the full height of the wall, and the vertical box channel 120 can be screwed into the board toward the top of the wall. A two-piece diagonal bracing pole 130 is joined at the threaded ends of each piece of the pole by a turnbuckle 132, which allows for adjustments in the length of pole 130. The diagonal pole is attached to the ground or sub-floor at one end 130', and to the box channel 120 at the opposite end 130". A standard scaffold angle 140 is also attached to the vertical box channel 120 to support scaffolding upright 150 and planks 152. Adjustments in the length of diagonal pole 130 by turning turnbuckle 132 result in end 130" of pole 130 either pushing or pulling on vertical box channel member 120, thus affecting the angle of the wall formed from the stacked ICF blocks. A disadvantage of this type of alignment system is that it requires the step of screwing a structural member such as vertical box channel 120 into the furring strips 124 or into a wooden board of strong-back that is in turn screwed into the furring strip, in order to provide a member for transferring loads such as wind loads from the ICF wall to bracing members such as diagonal pole 130. Furthermore, this system has height limitations, imposed by the standard length of 2"×6" boards.

Hence, the foregoing discussion shows that there is a need for a temporary bracing system capable of supporting ICF walls during construction, particularly in high wall applications, that can be easily and reliably used with a variety of known falsework systems.

SUMMARY OF THE INVENTION

The invention solves the problems and avoids the disadvantages of the prior art by providing a system and method for efficiently and effectively bracing an ICF to conventional falsework. The system of the invention must provide adequate structure to transfer all of the construction loads on the ICF to the falsework. Wind loads increase with height above ground and vary depending upon factors such as geographic location, proximity to open areas and wind tunneling effect of adjacent structures. Conventional structural design generally requires that construction bracing of tall walls be kept in place until the top edges of the walls are supported laterally such as by a roof structure. The pouring of concrete into the wall forms also creates an alignment load that must be compensated for in order to maintain the poured wall in a vertical position. The hydrostatic pressure created by liquid concrete being poured into the wall form is carried by and retained by panels and connecting structure within the ICF. If the pouring of concrete into the wall form is not done in stages to allow the concrete to start to set before the height of liquid concrete becomes too great, hydrostatic pressure would become more significant as the height of the wall is increased and the rate of pouring is increased. An excessive rate of pouring of liquid concrete could result in a "blow out" of the insulation panels on the ICF.

In a first aspect of the invention, these problems are solved by providing a system for temporarily bracing an insulated wall form that includes a bracing member, such as conventional falsework, an anchoring member, which may take the form of a bar that is adapted to be set in concrete poured into the wall form, and a tensioning member, such as a flexible strap that is connected between the bracing member and the anchoring bar. In this system, the strap can be threaded through openings in the form wall and extended around the bracing member and the anchoring bar with opposite end portions of the strap overlapping and being fixed to intermediate portions of the strap. The end portions of the strap may be fixed to the intermediate portions of the strap with any type of crimping connections known in the art, such as heat or friction sealing, crimp sealing using a crimp connector made from sheet steel, or an over center connector commonly made of wire. Crimp connectors are preferable because they are easier to use in the field as they do not require electricity or clean and dry conditions. With strong enough strap material, such as polyester, the opposite end portions of the strap could be connected with only one crimp connector.

In another aspect of the invention, a method is provided for temporarily bracing a wall form having at least one insulating panel adapted to form an exterior surface of an insulated concrete wall. Web members bridge across the width of the wall form and are connected to the insulating panel for supporting the insulating panel against concrete to be poured into the wall form. This method includes positioning an anchoring member, such as an anchoring bar, into engagement with the web members and positioning a temporary bracing member adjacent the insulating panel of the wall form. Openings are then cut through the insulating panel at each side of the bracing member and a flexible tensioning member is threaded through one slot at one side of the bracing member, around the anchoring bar, and back out through a second slot at another side of the bracing member. The strap is held in place relative to the bracing member by extending the strap around the bracing member and connecting opposite end portions of the strap to intermediate portions of the strap using crimping connectors. A wedge can also be inserted between the strap and the bracing member in order to adjust the tension of the strap.

The system provides an inexpensive, relatively easy to install structure that supports the ICF against loads imposed during construction and before a roof or other lateral support is in position across the top edges of the finished walls, as well as providing a simple and effective method for maintaining the ICFs straight and plumb during construction. The high strength of the flexible tensioning member and anchoring bar set in the concrete also provides a safe structure for temporary scaffolding, if desired. Use of a plastic strap as the tensioning member has significant advantages over metal. The plastic strap has a lower conduction of heat through the wall, and will not corrode or stain the wall like metal.

Additional features and advantages of the invention will be set forth or be apparent from the description that follows. The features and advantages of the invention will be realized and attained by the structures and methods particularly pointed out in the written description and claims hereof as well as the appended drawings.

It is to be understood that both the foregoing general description and the following detailed description are exemplary and explanatory and are intended to provide explanation and context for the invention, the scope of which is limited solely by the appended claims.

BRIEF DESCRIPTION OF THE DRAWINGS

The accompanying drawings, which are included to provide a further understanding of the invention and are incorporated in and constitute a part of the specification, illustrate preferred embodiments of the invention and together with the detailed description below serve to explain the principles of the invention. In the drawings.

DESCRIPTION OF THE PREFERRED EMBODIMENTS

Figure 1:
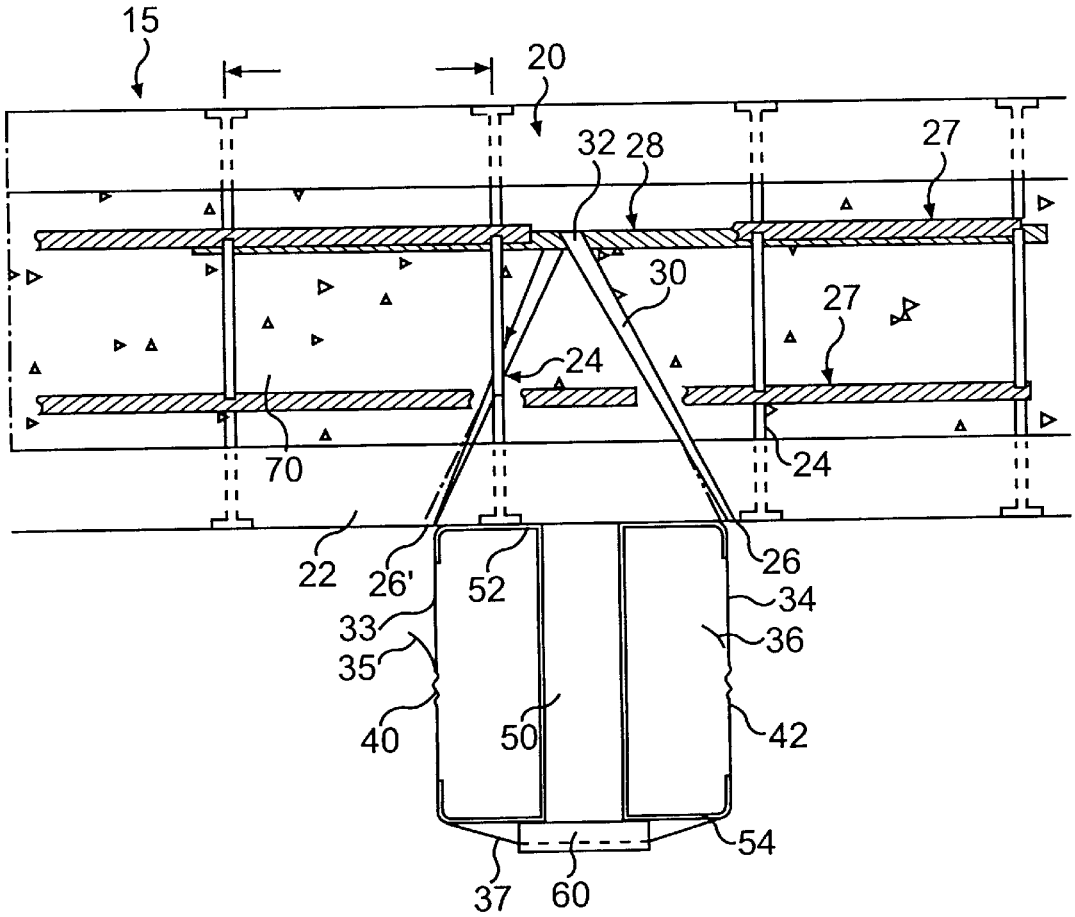
FIG. 1 is a plan view in partial cross section of a wall bracing system made in accordance with the principles of the invention.
Figure 2:
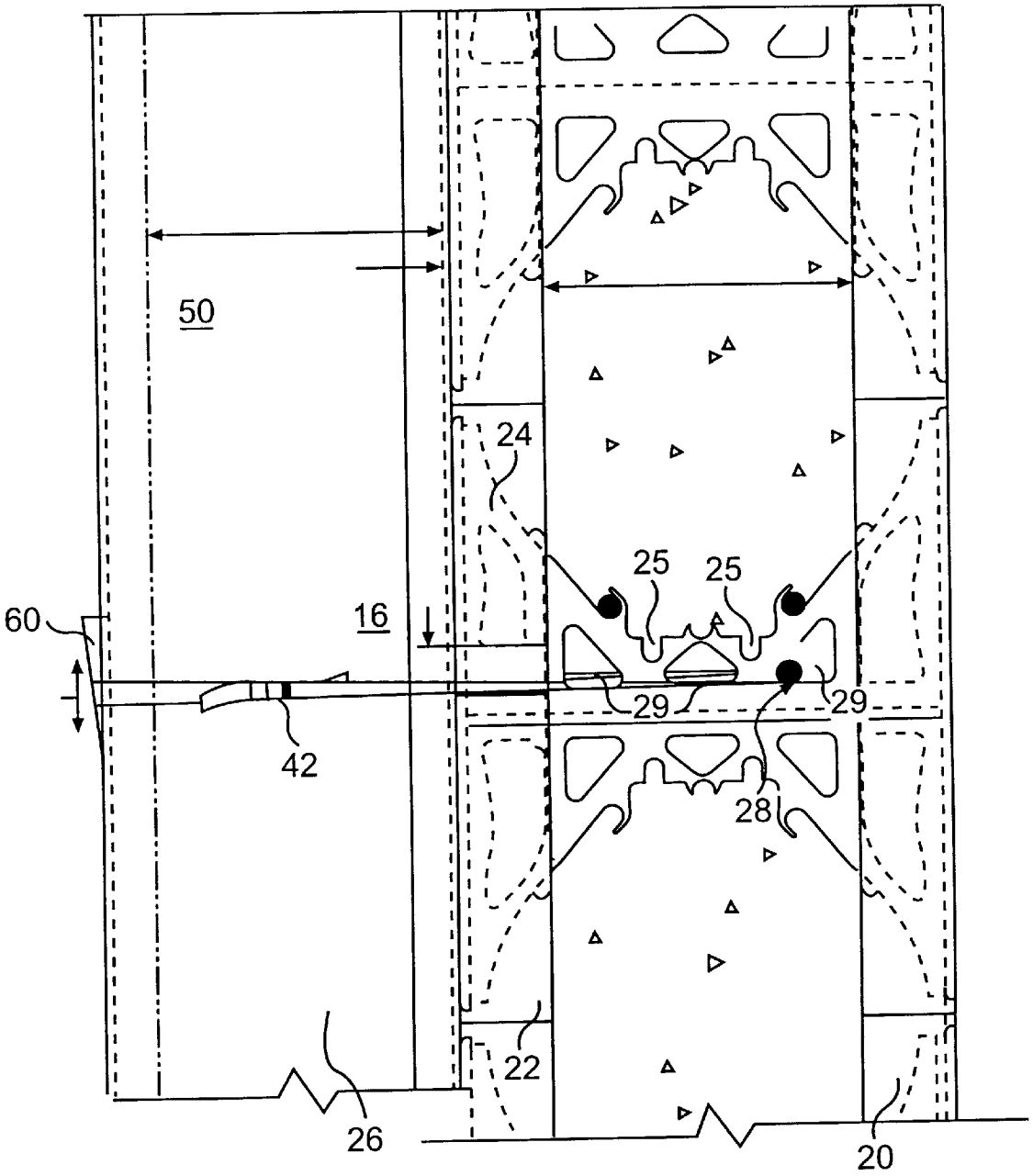
FIG. 2 is a side elevation view in partial cross section of the system of FIG. 1.
Figure 3:
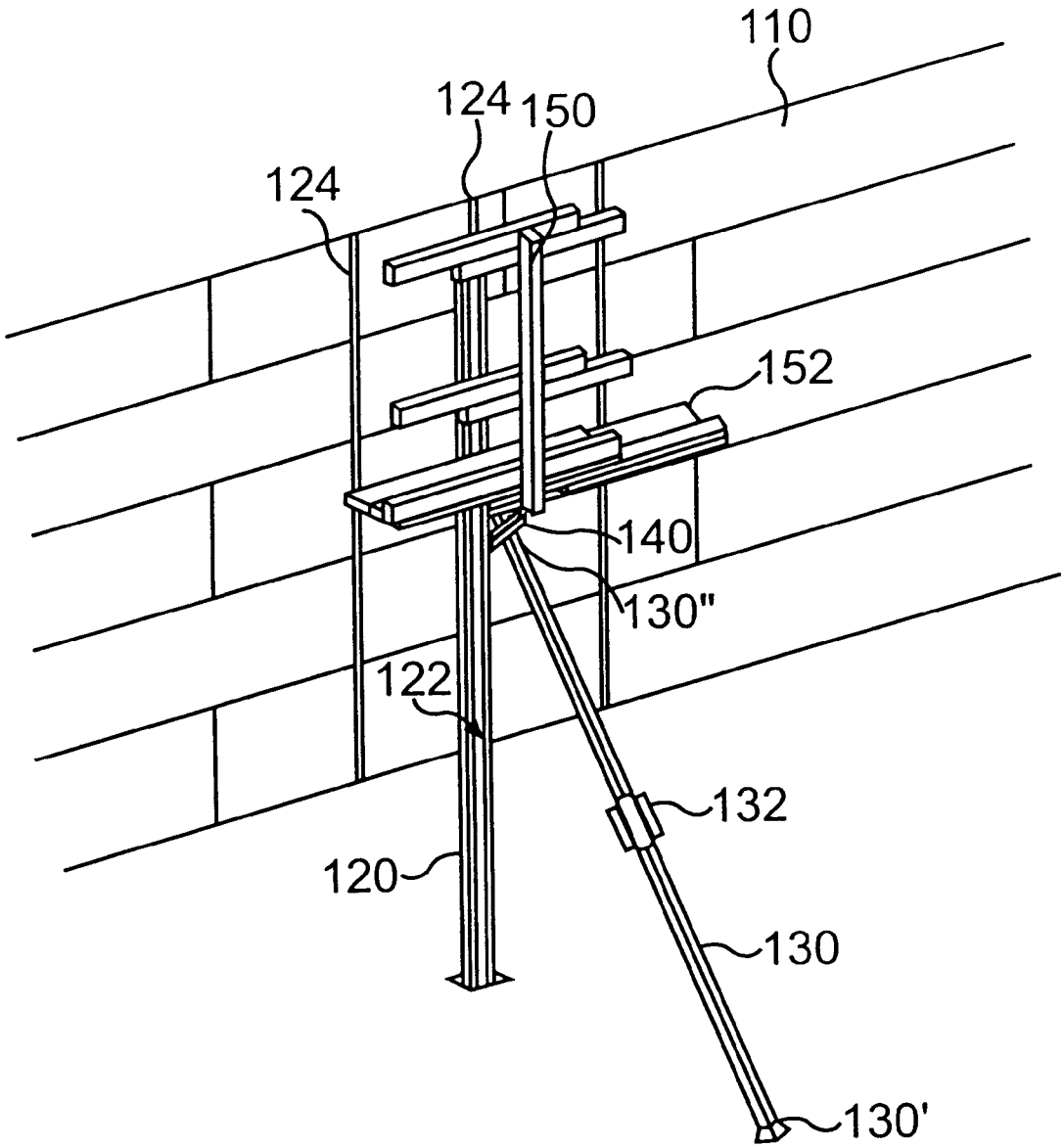
FIG. 3 PRIOR ART
FIG. 3 is a perspective view of a conventional Insulated Concrete Form wall bracing system.

Reference will now be made in detail to preferred embodiments of the invention, an example of which is illustrated in the accompanying drawings. FIG. 1 is a plan view in partial cross section of a system for bracing an insulated concrete form (ICF) wall against conventional falsework in accordance with the principles of the invention. FIG. 2 is a side elevation view in partial cross section of the system shown in FIG. 1. An ICF wall is made from first and second parallel and spaced side panels 20, 22 of the type preferably made from expanded polystyrene as shown in FIGS. 1 and 2 and described in more detail in U.S. Pat. Nos. 5,390,459, 5,657,600, and 5,809,727, the disclosures of which have been incorporated by reference herein in their entirety. The ICF wall is generally formed in convenient sized building components (also known as blocks) that can be stacked on each other to form a wall. Web members 24 extend between and connect insulating panels 20, 22 of individual ICF blocks together, e.g. by being molded into the panels, to resist forces applied by poured concrete. Notches 25 provided in web members 24 serve to support rebar 27 as well as an anchoring bar 28 for the wall bracing system, the function of which is described below. The bracing system of the invention could be used with any other conventional ICF systems including plank or panel ICF systems. Plank or panel ICF systems include form units that must be assembled on-site, in contrast to block systems, such as discussed in this application, which are individual units factory-assembled into blocks.

Each web member 24 may be formed from a single integral unit. The web members are preferably made of plastic. The preferred plastic is high density polypropylene, although polyethylene and other suitable polymers may be used. Multipiece web members may be used if the ability to vary the wall thickness at the jobsite is desired, as is well known in the art. The web members include end plates that may be embedded within the insulating panels, exposed on the outer surface of the panel, or partially exposed, which also is known in the art. However, it is preferred to have the end plates extend substantially the entire height of each panel, such that the end plates of adjacent panels of a wall form furring strips that are easily located for attaching a finishing material to the wall.

An anchoring member, such as anchoring bar 28, is provided within the ICF wall to attach the wall to falsework during construction. Anchoring bar 28 is preferably a steel bar having a minimum length of 34 inches and a minimum diameter of ½ inch. Reinforcing steel bar such as the steel bar used for rebar 27 of size number 4 can be used for the anchoring bar. Alternative shapes for the anchoring bar 28 could include round bars of different diameters and lengths as well as hexagonal or square bars. The primary function of the anchoring bar is to distribute loads from the bracing system, as described below, across a number of the web members before the concrete is poured into the form and sets. In a preferred embodiment of the invention the anchoring bar spans across at least five of the web members. A skilled artisan will recognize that the anchoring bar could be formed from any member to which a tensioning member of the invention, e.g., flexible strapping, could be fixed and subsequently embedded in the concrete wall.

A bracing member 50 is used to keep ICF 15 straight and plumb during construction, and may be selected from any commercially available equipment such as falsework used in conventional forming of concrete walls and sold by EFCO of Des Moines, Iowa under the "SUPERSTUD" name. Bracing member 50 is positioned with its inner side 52 against the outer surface of insulated panel 22. Before placement of blocks of ICF 15 against bracing member 50, anchoring bar 28 is inserted through preferably triangular holes 29 in web members 24 of the ICF 15. Of course, any other shape hole could be used, but triangular shaped holes have the advantage of preventing vertical movement of the anchoring bar. Alternate locations for the anchoring bar 28 include notches 25 in web members 24 or other convenient locations which could differ depending upon the particular design of web used.

After ICF 15 is positioned against bracing member 50, the anchoring bar 28 is positioned so that it contacts preferably the five web members 24 closest to the bracing member 50.

Openings 26, 26' are cut through insulating panel 22, preferably at both sides of bracing member 50 where bracing member 50 contacts the insulating panel 22. A tensioning member, such as a strap 30 of suitable, flexible material is inserted through opening 26, rotated 90° about its longitudinal axis, wrapped around anchoring bar 28, rotated another 90° about its longitudinal axis, and passed back through second opening 26'. The strap 30 is long enough such that opposite end portions 35, 36 of strap 30 can be extended around the back side 54 of bracing member 50 and connected to intermediate portions 33, 34 of strap 30 using crimp connectors 40, 42. Crimp connectors 40, 42 are preferably sheet metal clips that are crimped over the overlapping ends of strap 30 to make a joint in the strap. Alternatively, a single crimp connector could be used with or without overlap of the strap if the strap is made from a strong enough material such as polyester.

In a preferred embodiment of the invention strap 30 is made from polyester material. Alternative materials such as polypropylene, nylon or metal could also be used for strap 30 as long as the materials provide sufficient strength and allow sufficient flexibility for the strap to form a band of material that encompasses the anchoring bar in the ICF 15 and bracing member 50. Other types of tensioning members include any other structural member known to carry tension loads suitable for use with ICFs.

In a preferred embodiment, the openings 26, 26' through insulating wall 22 provide approximately ⅜ inch clearance above the upper edge of strap 30 in order to allow for settling of ICF 15 during pouring of concrete 70 in between insulating panels 20, 22.

After strap 30 is placed around anchoring bar 28 and bracing member 50 the strap is pulled tight in order to bring all of the slack to the back side 54 of bracing member 50. Opposite end portions 35, 36 of strap 30 are wrapped around bracing member 50 leaving enough slack so that a wedge 60 can be inserted between the overlapped strap and the back side 54 of bracing member 50. The wedge 60 allows for adjustments in the tension of strap 30. A crimping connector 40 is installed around the double thickness of strap formed by end portion 35 and intermediate portion 33 and then crimped with a crimping tool. The opposite end portion 36 of strap 30 is pulled to the other side of bracing member 50 and a second crimping connector 42 is crimped around end portion 36 and intermediate portion 34.

After both crimping connectors 40, 42 are in position, wedge 60 is inserted between the back side 54 of bracing member 50 and the double thickness of strap 37 extending around the back side of bracing member 50. Wedge 60 is only inserted with sufficient hand force to pull the ICF 15 into contact with bracing member 50, thereby ensuring alignment of ICF 15 against bracing member 50. With the ICF secured and aligned against the bracing member, concrete or other pourable building materials are poured into the ICF, filling the space between insulating panels 20, 22, around web members 24, around rebar 27 and anchoring bar 28, and around strap 30. After the concrete has hardened, and a roof or other reinforcing structure is connected across the top edges of the ICF to provide lateral support, strap 30 may be cut flush with the outer surface of insulating panel 22 and bracing member 50 may be removed.

What is claimed is:

1. A bracing system in combination with an insulated wall form, said combination comprising:

said wall form having generally parallel spaced panels, at least one of which is formed from insulating material, and at least one bridging member connecting the panels together with said at least one bridging member having opposite end plates, each of which is positioned at least partially within one of said panels;

a first member for bracing the wall form during construction;

a second member adapted to be set in pourable building material received in the wall form, said second member being supported on said at least one bridging member; and a flexible tensioning member attaching said first member and said second member, said second member distributing loads to the wall form through said at least one bridging member.

2. The combination according to claim 1, further including a wedge inserted between said first member and said flexible tensioning member to tighten the attachment between the first and second members.

3. The combination according to claim 1, wherein said flexible tensioning member comprises a strap.

4. The combination according to claim 3, wherein said strap extends around said first member and said second member with opposite end portions of said strap overlapping and each being fixed to intermediate portions of said strap.

5. The combination according to claim 4, wherein said end portions of said strap are fixed to said intermediate portions of said strap with crimp connectors.

6. The combination according to claim 3, wherein said strap is turned no more than approximately 90 degrees about its longitudinal axis between a point of contact with said first member and a point of contact with said second member.

7. An insulated wall form in combination with a bracing apparatus, said combination comprising:

said wall form having generally parallel spaced panels, at least one of which is formed from insulating material, and at least one bridging member connecting the panels together with said at least one bridging member having opposite end plates, each of which is positioned at least partially within one of said panels;

a bracing member for temporarily supporting the insulated wall form that remains a permanent part of a wall;

an anchoring member adapted to become a permanent part of a wall constructed from the insulated wall form;

a tensioning member connecting said bracing member and said anchoring member, wherein said tensioning member comprises a flexible strap, said anchoring member being capable of distributing loads to the insulated wall form; and an adjusting member for tightening the connection between said bracing member and said anchoring member.

8. The combination of claim 7, wherein said bracing member comprises falsework.

9. A method of temporarily bracing an insulated wall form including the steps of:

positioning a temporary bracing member adjacent the wall form, said wall form having generally parallel spaced panels, at least one of which is formed from insulating material, and at least one web member connecting the panels together and supporting the panels with said at least one web member having opposite end plates, each of which is positioned at least partially within one of said panels; and tensioning a flexible member disposed between a permanent part of the wall form supported on said at least one web member and the bracing member to attach the bracing member to the wall form.

10. The method of claim 9, further including the step of tightening the flexible member by inserting a wedge between the flexible member and the bracing member.

11. The method of claim 9, wherein said tensioning step comprises providing at least one opening in the wall form and threading the flexible member through said at least one opening.

12. The method of claim 11, wherein the permanent part of the wall form comprises an anchoring member disposed in the wall form and said threading step comprises positioning the flexible member around the anchoring member.

13. The method according to claim 12, wherein said flexible member is twisted no more than approximately 90 degrees about its longitudinal axis between each of the openings and the anchoring member.

14. The method of claim 12, wherein said step of providing at least one opening in the wall form comprises providing two openings in the wall form adjacent opposing sides of the bracing member, and said tensioning step comprises wrapping the flexible member around the anchoring member.

15. The method of claim 14, wherein said flexible member comprises a strap and said tensioning step comprises extending opposite end portions of the strap around the bracing member and fixing the end portions of the strap to intermediate portions of the strap.

16. The method of claim 15, wherein said fixing step comprises connecting the end portions of the strap to the intermediate portions with crimping connectors.

* * * * *